United States Patent [19]

Merrigan

[11] 4,067,150

[45] Jan. 10, 1978

[54] SANDBLAST ABRADING APPARATUS

[75] Inventor: James P. Merrigan, Walnut Creek, Calif.

[73] Assignee: Argonite, Inc., Pleasant Hill, Calif.

[21] Appl. No.: 628,325

[22] Filed: Nov. 3, 1975

[51] Int. Cl.[2] ..... B24C 7/00; B24C 5/04

[52] U.S. Cl. ..... 51/436; 51/439; 222/196; 239/142; 239/317

[58] Field of Search ..... 51/8 R, 8 HD, 11, 12, 51/263; 222/196; 259/DIG. 42; 239/61, 102, 142, 144, 310, 317

[56] References Cited

U.S. PATENT DOCUMENTS

| | | | |
|---|---|---|---|
| 2,496,194 | 1/1950 | Bennett | 51/8 |
| 2,643,456 | 6/1953 | Mauer | 51/8 X |
| 2,751,716 | 6/1956 | Pletcher | 51/11 |
| 3,139,705 | 7/1964 | Histed | 51/12 X |
| 3,374,581 | 3/1968 | Millhiser | 51/8 |
| 3,490,655 | 1/1970 | Ledgett | 222/196 |
| 3,768,210 | 10/1973 | Johnson | 51/12 |

*Primary Examiner*—Gary L. Smith
*Attorney, Agent, or Firm*—Naylor, Neal & Uilkema

[57] ABSTRACT

Air from a source of pressurized air, acting through a ball-type vibrator and a resilient mounting, serves to form a cloud of abrasive material within a reservoir of such material. Air from the same source serves to aspirate a continuous charge of the cloud of material and to discharge it from a nozzle.

5 Claims, 7 Drawing Figures

SANDBLAST ABRADING APPARATUS

An object of the invention is to form a variable density cloud of fine particle abrading material and to provide means for directing a continuous stream of such material against an object which is to be abraded.

A further object of the invention is to provide a simple and efficient handling system for fine particle abrading material including the utilization of a source of pressurized air to both form the material into a cloud condition and to discharge the material in that condition through a nozzle.

Other objects and advantages of the invention will be apparent from the following description taken in conjunction with the drawings forming part of this specification, and in which:

FIG. 2 shows the apparatus in approximately 1:1 size.

Figure 1:
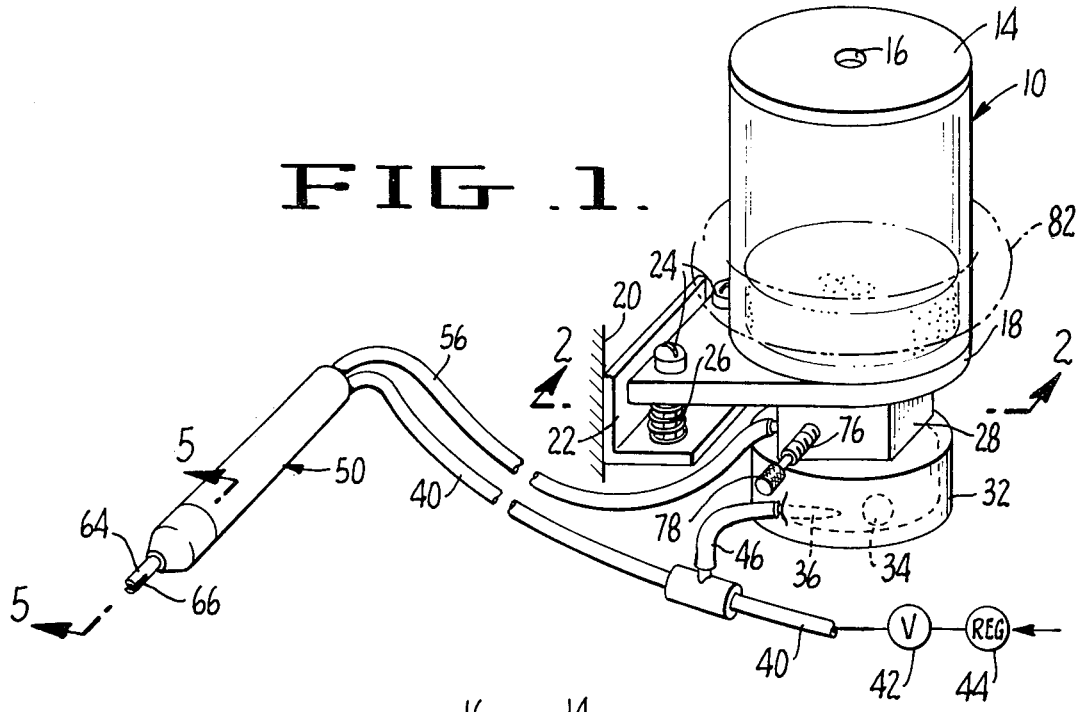
FIG. 1 is a view in perspective of the apparatus of the invention.

The apparatus comprises a container 10 for the fine particle alumina, or other desired abrading material, 12. The container 10 is preferably provided with transparent walls so that the condition of the abrading material can be observed during operation of the apparatus. The container is provided with a removable top 14 which in turn is provided with an air breather aperture 16. The container is mounted on a plate member 18, and the latter is resiliently attached to a base support member 20 by means comprising an angle member 22, bolts 24 extending through the plate member 18 and the angle member 22, and springs 26 sleeved over the bolts 24.

Attached to the underside of the plate member 18 is a block 28. An outlet chamber 30 for the receptacle 10 is formed in the plate member 18 and block member 28.

Fixedly secured to the block member 28 is a housing 32 which houses a ball member 34, preferably formed of nylon. An air line 36 communicates with the interior of the housing 32 tangentially thereof. The housing is provided at its underside with air discharge ports 38.

An air line 40 is connected to a source, not shown, of pressurized air through a valve 42 and a regulator 44. Line 40 has a branch connection 46 with the housing inlet line 36. Line 40 is attached to the inlet end of a tube 62 of nozzle assembly 50. The outlet end of tube 48 is bent through 90° to discharge generally tangentially into chamber 52 defined within the handle member 54 of the nozzle assembly 50.

A particle conveying line or conduit 56 is attached to the block member 28 so as to communicate with chamber 58 formed therein. Conduit 60 interconnects chamber 58 with the reservoir chamber 30. Conduit 56 is attached to the inlet end of tube 48 of the nozzle assembly 50. The outlet end of the tube 62 discharges into the chamber 52 centrally and axially thereof. The nozzle assembly is provided with a discharge nozzle tube 64, the inlet end of which is internally tapered at 66 and disposed in concentric, spaced relation to the outlet end of tube 62. The nozzle tube is provided with a plurality of particle discharge slots 67 which prevent the abrading material particles from piling up and compacting within the tube 64 when the discharge end thereof is temporarily blocked, as by engagement with an article being abraded.

The apparatus is provided with abrading materials flow control means comprising an ambient air passageway 68 having a tapered outlet 70 communicating with the compartment 58. A valve rod 72 having a tapered end 74 is carried by a threaded plug 76 which is threadably engaged with the block 28 and adapted to be rotated by knob number 78.

Figure 4:
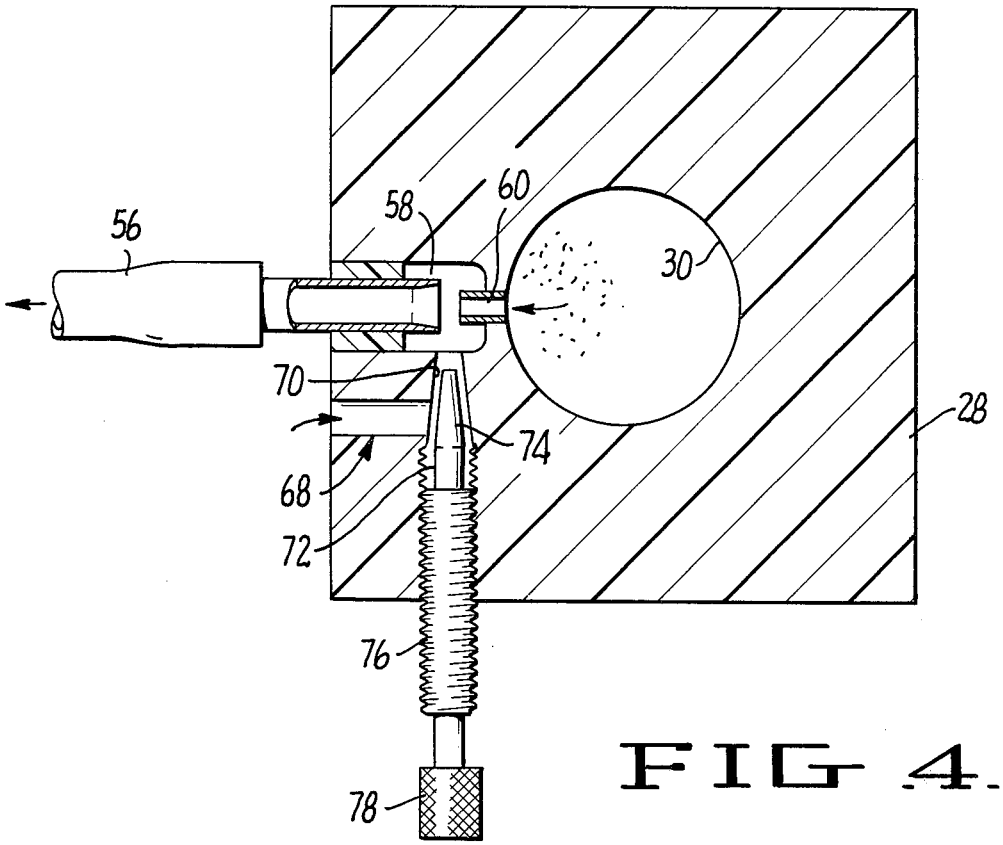
FIG. 4 is an enlarged view taken along lines 4—4 of FIG. 2.
Figure 5:
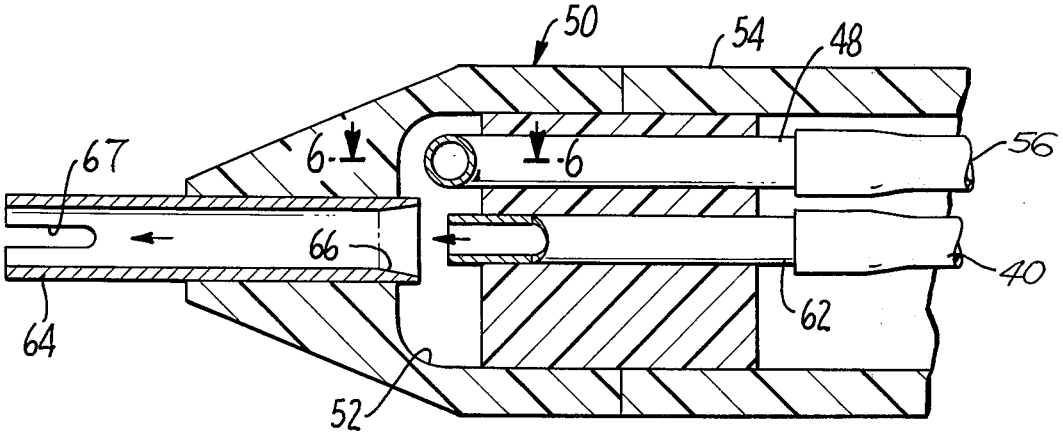
FIG. 5 is an enlarged view taken along lines 5—5 of FIG. 1.
Figure 6:
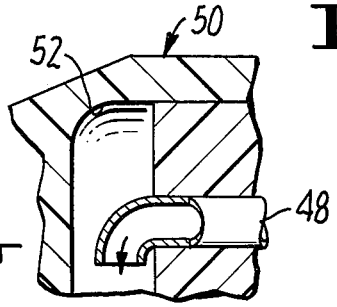
FIG. 6 is a view taken along lines 6—6 of FIG. 5.

The air conveying system of the apparatus has some important dimensional relationships. Considering, first, the material inlet end of the air conveyor system shown in FIG. 4, the inside diameter of the conduit 60 should be approximately one-half of the inside diameter of the adjacent inlet end of conduit 56, and the space between them should be substantially equal to the internal diametral dimension of the conduit 60. Considering the outlet end of the air conveyor system for the abrading material, as shown in FIG. 5, the inside diameter of the discharge tube 62 should be approximately one-half of the inside diameter of the adjacent end of the nozzle tube 64, and the axial distance between these two tube ends should be equal to or less than the internal diameter of the discharge end of tube 62.

Figure 3:
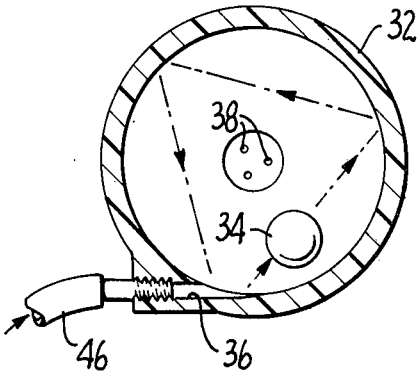
FIG. 3 is a view taken along lines 3—3 of FIG. 2.

The operation of the apparatus is as follows. The valve 42, which is preferably foot-controlled, is opened. This results in the vibrator ball 34 being bounced around the housing 32, as indicated in FIG. 3, as well as upwardly and downwardly within the housing. The resulting vibrational force acting through the spring mounting system causes the material particles 12 to levitate and form a cloud of spaced or free particles throughout the reservoir compartment 30 and the reservoir 10. The balance of the air in line 40 is discharged through the outlet end of tube 62 into the nozzle assembly chamber 52. The movement of the air from tube 62 into tube 64 within chamber 52 induces movement of the abrading material particles in cloud condition through the conduit 56 and out the discharge end of the nozzle tube 64.

The density of the particles within the cloud in the container 10 is controllable to a degree by controlling the vibration applied to the container 10. This may be accomplished by controlling the degree to which the valve 42 is opened.

The density of the particles per unit of volume of air discharge from the nozzle tube 64 is a function of the setting of the valve element 72 with reference to portion 70 of the ambient air passageway 68. A partial closing of this valve meters a lesser amount of ambient air into the cloud material entering the conduit 56, and a relative opening of the ambient control valve results in the metering of a greater amount of ambient air into the cloud material entering conduit 56. In the first instance, there is an increase in particle density at the discharge end of nozzle 64, and in the second instance there is a decrease in this density.

Figure 7:
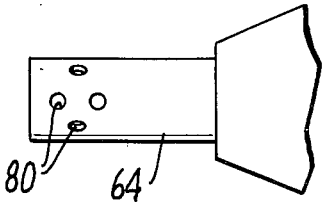
FIG. 7 is a view in side elevation of a modified form of discharge nozzle for the apparatus.

It is not possible under any condition of operation of the apparatus to cause the abrading material particles to agglomerate or compact with each other. This is prevented even when the outlet end of the nozzle tube 64 is blocked by the lateral passageway means for the particle material comprising the slots 67. As shown in FIG. 7, there may be provided in lieu of the slots 66 apertures 80.

Figure 2:
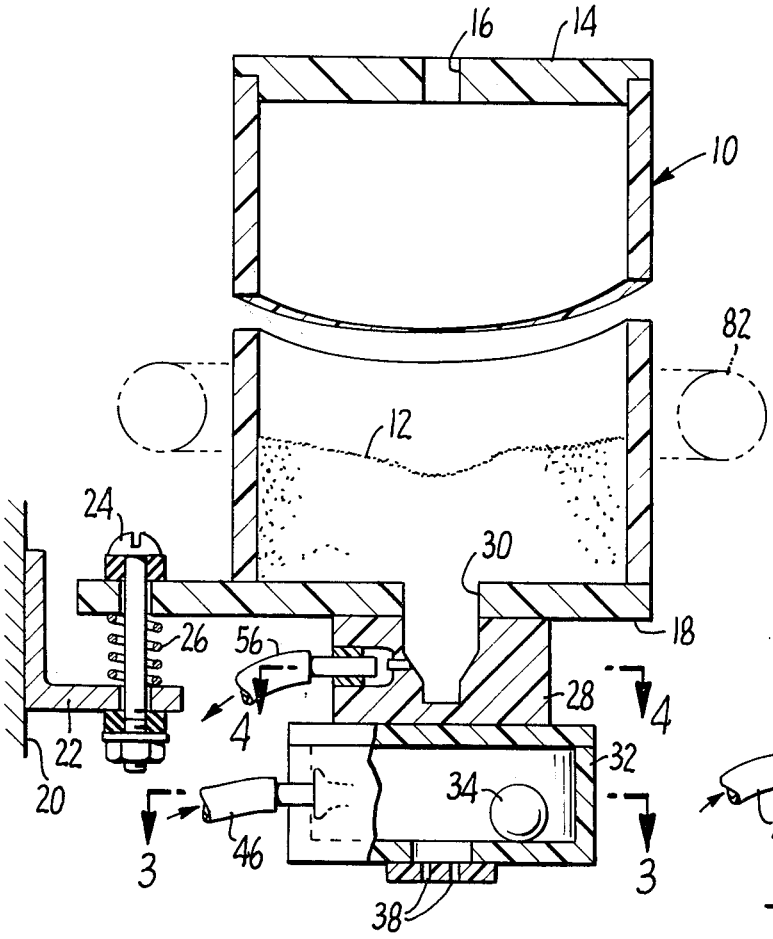
FIG. 2 is an enlarged view taken along lines 2—2 of FIG. 1.

As shown in FIG. 2, the apparatus may be provided with a quartz heater 82 to prevent the material 12 from clogging due to moisture in the air.

In the preferred embodiment of the apparatus the conduit 46 is connected directly to the pressurized air source and contains its own independent control valve and regulator, instead of branching off of the conduit 40 as shown in FIG. 1. The vibrator ball is effectively operated through a pressure range in conduit 46 of from about 35 to about 120 pounds per square inch.

What is claimed is:

1. Sandblast abrading apparatus comprising a container containing fine particle abrading material, and vibrator means attached to the container operable to vibrate it with components of both horizontal and vertical movement whereby said material is caused to become suspended in the form of a cloud within said container, said vibrator means comprising a housing having a bottom wall and having defined therein a cylindrical space, a ball member disposed within said space and movable therearound with horizontal and vertical components of movement, means to impart such movement to said ball member comprising a source of pressurized air, an air inlet connected to said source and tangentially communicating with said space, a vertically directed air outlet communicating with said space through said bottom wall, said vibrator means further comprising means resiliently and pivotally supporting said container for limited up and down arcuate movement.

2. Sandblast abrading apparatus comprising a container containing fine particle abrading material, vibrator means attached to the container operable to vibrate it whereby said material is caused to become suspended in the form of a cloud within said container, a nozzle assembly comprising a housing having a mixing chamber defined therein, a discharge tube communicating with said chamber, a particle conduit having one end communicating with said chamber and the other end communicating with said container, a source of pressurized air, and an air conduit interconnecting said source and said chamber and discharging into said chamber, a sub-housing carried by said container and having defined therein a sub-compartment, said other end of said particle conduit being in communication with said sub-compartment, said container being in communication with said sub-compartment through a feeder conduit, an ambient air conduit connected to said sub-compartment, and valve means to control the flow of ambient air into said sub-compartment and thereby control the amount of suspended material aspirated into said mixing chamber.

3. The apparatus of claim 2, said other end of said particle conduit and said feeder conduit being oppositely disposed, the former having an inside diameter which is approximately twice that of the latter and being spaced from the latter a distance which is approximately equal to the inside diameter of said feeder conduit.

4. The apparatus of claim 3, the internal diameter of said discharge tube at the end thereof which is at said mixing chamber being approximately twice that of the adjacent end of said air conduit and said ends being spaced apart a distance which is approximately equal to the internal diameter of said adjacent end of said air conduit.

5. The apparatus of claim 4, said last-mentioned ends being directly opposed to each other, said particle conduit discharging into said mixing chamber tangentially therein and at a location which is radially outward from said last-mentioned ends.

* * * * *